US005518374A

United States Patent [19]

Ota et al.

[11] Patent Number: 5,518,374

[45] Date of Patent: May 21, 1996

[54] VARIABLE CAPACITY SWASH PLATE TYPE COMPRESSOR HAVING PULSATION SUPPRESSING CHAMBER LOCATED CAPACITY CONTROL VALVE

[75] Inventors: Masaki Ota; Soukichi Hibino; Hisakazu Kobayashi, all of Kariya, Japan

[73] Assignee: Kabushiki Kaisha Toyoda Jidoshokki Seisakusho, Aichi, Japan

[21] Appl. No.: 501,772

[22] Filed: Jul. 13, 1995

[30] Foreign Application Priority Data

Jul. 29, 1994 [JP] Japan ..... 6-178378

[51] Int. Cl.[6] ..... F04B 1/29

[52] U.S. Cl. ..... 417/222.2; 417/312; 417/540

[58] Field of Search ..... 417/222.1, 222.2, 417/312, 540

[56] References Cited

U.S. PATENT DOCUMENTS

| | | | |
|---|---|---|---|
| 1,952,994 | 3/1934 | Laird | 417/540 |
| 4,534,710 | 8/1985 | Higuchi et al. | 417/312 |
| 4,610,604 | 9/1986 | Iwamori | 417/312 |
| 4,729,718 | 3/1988 | Ohta et al. . | |

FOREIGN PATENT DOCUMENTS

| | | | |
|---|---|---|---|
| 3-61680 | 3/1991 | Japan . | |
| 4029510 | 3/1991 | Japan | 417/222.2 |

*Primary Examiner*—Richard A. Bertsch
*Assistant Examiner*—Roland G. McAndrews, Jr.
*Attorney, Agent, or Firm*—Burgess, Ryan & Wayne

[57] ABSTRACT

A variable capacity refrigerant compressor, particularly a single headed piston type variable capacity refrigerant compressor having a framework unit including at least a cylinder block and defining a pulsation suppressing chamber therein fluidly communicating with a discharge chamber of a rear housing and connected to an external refrigerating system, the pulsation suppressing chamber suppressing pulsation in the discharge pressure of the compressed refrigerant before the refrigerant flows toward the refrigerating system, the pulsation suppressing chamber also fluidly communicating with a crank chamber defined by a front housing and the cylinder block so as to supply the crank chamber with the refrigerant at a high pressure an amount of which is regulated by a capacity control valve integrally accommodated in the pulsation suppressing chamber.

7 Claims, 3 Drawing Sheets

VARIABLE CAPACITY SWASH PLATE TYPE COMPRESSOR HAVING PULSATION SUPPRESSING CHAMBER LOCATED CAPACITY CONTROL VALVE

BACKGROUND OF THE INVENTION

1. Field of the Invention

The present invention relates to a variable capacity refrigerant compressor, and more particularly, it relates to a single headed piston type variable capacity refrigerant compressor integrally incorporating therein a means for suppressing pulsation of the discharge gas and a capacity control valve.

2. Description of the Related Art

U.S. Pat. No. 4,610,604 to Iwamori discloses a double-headed piston type compressor with a muffling arrangement to weaken the pulsation in the discharge pressure of the refrigerant gas. In the compressor of U.S. Pat. No. 4,610,604, a connecting flange is attached to the radial wall extending externally radially from the central portion of the compressor housing to define a muffling chamber having an appreciable volume therein, to thereby deaden the pulsation in the discharge pressure of the discharge refrigerant gas.

On the other hand, in single headed piston type refrigerant compressors having therein a swash plate type piston drive mechanism or a wobble plate type piston drive mechanism, a gas inlet port and a gas outlet port of the compressor are generally provided in the rear housing of the compressor so as to be connected to an external refrigerating system. This is because in the single headed piston type refrigerant compressor, since the refrigerant gas is compressed by the single head of each of the plurality of pistons, the number of the pistons incorporated in the cylinder block of the single headed piston type compressor must be necessarily larger than that of the double headed piston type compressor, in order to discharge a comparable amount of compressed refrigerant gas therefrom. Therefore, the cylinder block of the single headed piston type compressor is provided with a larger number of cylinder bores formed therein compared with that of the double headed piston type compressor, and accordingly, the cylinder block of the single headed piston type compressor cannot be designed so as to have a fluid passageway or passageways formed therein. Thus, the cylinder block of the single headed piston type compressor cannot have a muffling means incorporated therein to suppress or damp the pulsation in the discharge pressure of the compressed refrigerant gas, and the muffling means is directly arranged inside the rear housing. Further, in many single headed piston type compressors provided with a capacity control unit, the capacity control valve for controlling a pressure in the crank chamber thereof is housed in the rear housing. Thus, the rear housing having the muffling means and the capacity control valve therein causes the entire size and volume of the compressor to become large and swelled, and accordingly, it is difficult to use such a large and swelled compressor for the refrigerating system of compact automobiles. Additionally, the single headed piston type compressor must unavoidably be provided with its delivery port of the compressed refrigerant, located at a rear portion thereof, and therefore, when the compressor is mounted in the engine compartment of an automobile, the discharge port provided at the rear portion of the compressor often does not permit pipes and hoses for the refrigerant to be appropriately arranged in the engine compartment of the automobile. This is very inconvenient from the viewpoint of manufacturing and assembling automobiles.

SUMMARY OF THE INVENTION

Accordingly, a principal object of the present invention is to eliminate the defects encountered by the conventional single headed piston type refrigerant compressor.

Another object of the present invention is to provide a means for suppressing pulsation in the discharge pressure of the refrigerant delivered from a refrigerant compressor, especially but non-exclusively a single headed piston type refrigerant compressor, without an increase in the size of the compressor.

A further object of the present invention is to provide a single headed piston type variable capacity refrigerant compressor provided with a framework unit in which a refrigerant compressing mechanism, a means for suppressing pulsation in the discharge pressure, and a capacity control valve are integrally incorporated.

In accordance with the present invention, there is provided a variable capacity refrigerant compressor which comprises:

- a framework unit including an axial cylinder block having axially front and rear ends and a plurality of cylinder bores formed therein, a front housing arranged so as to close the front end of the cylinder block, and define a crank chamber therein, and a rear housing arranged so as to close the rear end of the cylinder block and define at least one discharge chamber therein, the framework unit having a suction pressure region therein for receiving a refrigerant before compression;
- a plurality of reciprocating pistons received in the plurality of cylinder bores of the cylinder block to compress a refrigerant;
- a drive shaft rotatably held by the cylinder block and the front housing of the framework unit, and receiving an externally applied drive force;
- a swash plate element mounted so as to be rotated together with the drive shaft to thereby reciprocate the plurality of pistons, and capable of changing its angle of inclination with respect to a plane perpendicular to the axis of rotation of the drive shaft;
- a gas extraction passageway means for providing a constant fluid communication between the crank chamber and the suction pressure region of the framework unit;
- a unit for defining a pulsation suppressing chamber in the framework in such a manner that the pulsation suppressing chamber communicates with the discharge chamber of the rear housing and with an external refrigerating system;
- a unit for defining a gas supply passageway interconnecting between the pulsation suppressing chamber and the crank chamber; and
- a capacity control valve unit accommodated in the pulsation suppressing chamber so as to regulate an amount of flow of a gas flowing through the gas supply passageway, in response to a change in a suction pressure of the refrigerant, to thereby constantly control a pressure prevailing in the crank chamber.

Preferably, the pulsation suppressing chamber is formed so as to internally extend through both the cylinder block and the front housing of the framework unit.

The pulsation suppressing chamber is provided with a recessed oil chamber formed therein to receive a lubricating oil, and the gas supply passageway has an open end opening in the recessed oil chamber.

The afore-mentioned swash plate element may be either a wobble plate element consisting of an assembly of a rotating swash plate and a non-rotating wobble plate which is connected to the plurality of reciprocating pistons via connecting rods or a rotating swash plate directly connected to the reciprocating pistons via rotation-to-reciprocation converting shoes.

The compressed refrigerant at a high pressure, discharged from the respective cylinder bores toward the discharge chamber is introduced into the pulsation suppressing chamber so that the pulsation in the discharge pressure of the compressed refrigerant is sufficiently deadened or damped by an expanding and muffling function exhibited by the pulsation suppressing chamber. The compressed refrigerant is then delivered toward the external refrigerating system via the delivery port of the compressor.

During the operation of the compressor, when a thermal load is reduced, and when the delivery capacity of the compressor is reduced, the capacity control valve accommodated in the pulsation suppressing chamber increases the amount of flow of the compressed refrigerant supplied by the gas supply passageway from the pulsation suppressing chamber into the crank chamber.

In accordance with the above-mentioned arrangement of the variable capacity refrigerant compressor, the pulsation suppressing chamber is formed so as to internally extend through the cylinder block and the front housing, and so as to integrally receive the capacity control valve therein. Thus, the rear housing can be simple and small resulting in reducing the entire size and the entire axial length of the compressor. Further, the pulsation in the discharge pressure of the compressed refrigerant during the operation of the compressor can be sufficiently suppressed. Furthermore, since the delivery port of the compressed refrigerant can be arranged at a central portion of the compressor via an appropriate flange element mounted on the central portion, an arrangement of pipes and hoses for the refrigerant can be made flexible when the compressor is mounted in the engine, compartment of an automobile.

When the pulsation suppressing chamber of the framework is arranged so as to internally extend through the front housing and the cylinder block, the volume of the pulsation suppressing chamber can be large enough to effectively suppress the pulsation in the discharge pressure of the compressed refrigerant. Thus, a noise generated by the operation of the compressor is effectively reduced.

When the pulsation suppressing chamber is provided with a recessed oil chamber formed therein to receive a lubricating oil, and when the gas supply passageway has an open end disposed in the recessed oil chamber, the lubricating oil which is inertially separated from the refrigerant gas by the use of a differential of specific gravity between the refrigerant and oil and is stored in the recessed oil chamber is led into the crank-chamber during the regulating operation of the capacity control valve. Therefore, the lubricating oil lubricates the moving and sliding elements in the crank chamber of the compressor even when the delivery capacity of the compressor is reduced so that the amount of refrigerant circulating through the refrigerating system is also small.

BRIEF DESCRIPTION Of THE DRAWINGS

The present invention will be made more apparent from the ensuing description of a preferred embodiment thereof with reference to the accompanying drawings wherein.

DESCRIPTION OF THE PREFERRED EMBODIMENT

Figure 1:
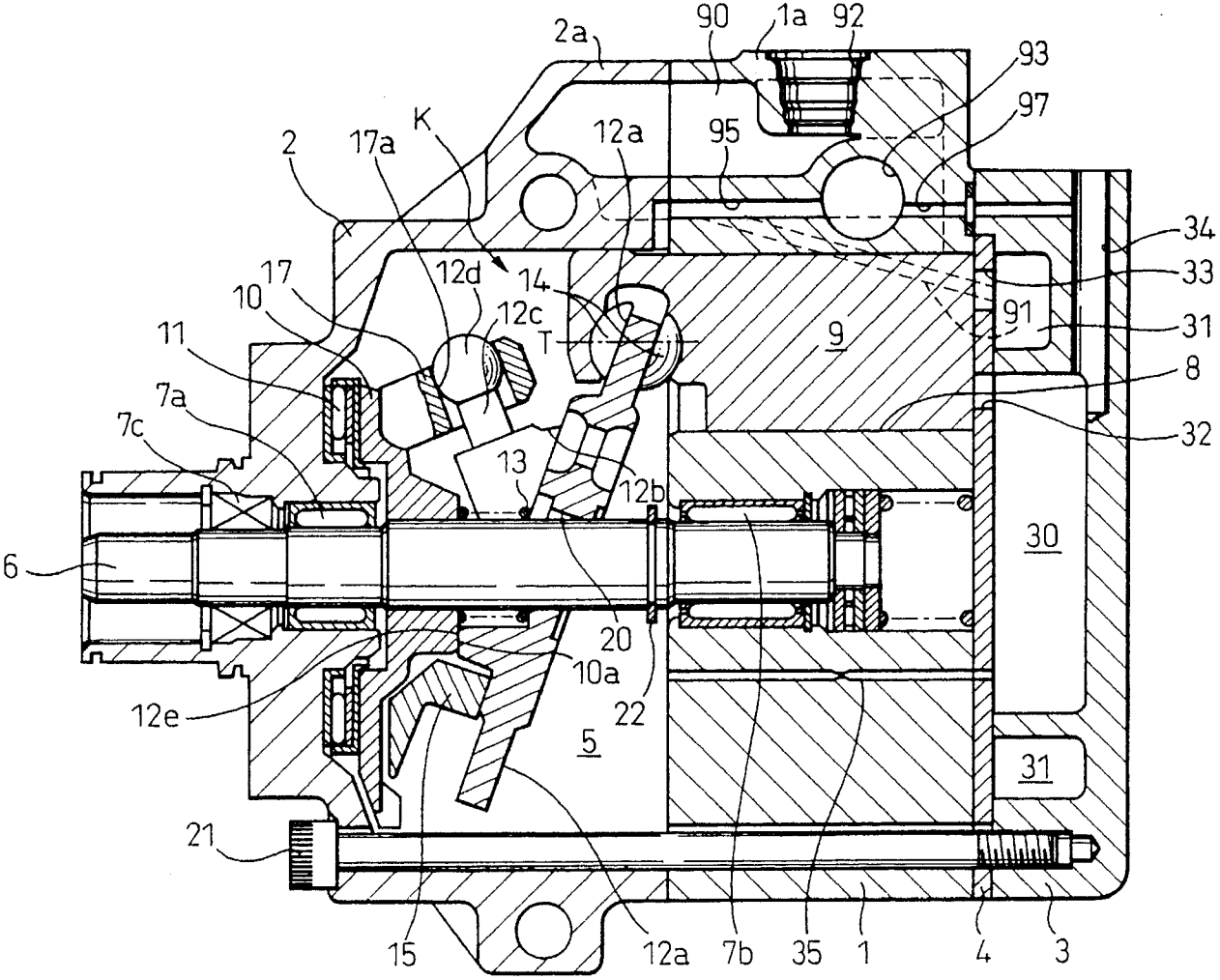
FIG. 1 is a longitudinal cross-sectional view of a single headed piston type variable capacity refrigerant compressor according to an embodiment of the present invention.
Figure 2:
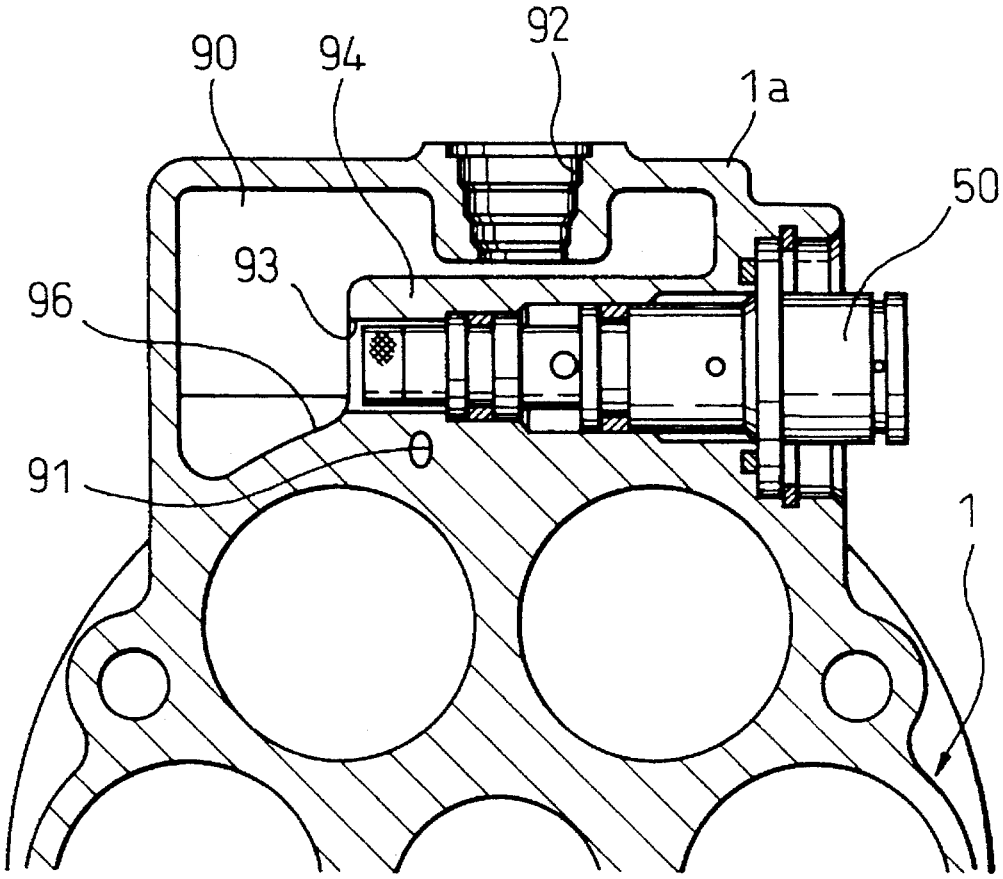
FIG. 2 is a partial cross-sectional view of a part of the compressor of FIG. 1, illustrating a pulsation suppressing chamber formed in the framework of the compressor.

Referring to FIGS. 1 and 2, a single headed piston type variable capacity refrigerant compressor is provided with a framework including a cylinder block 1 formed as a generally cylindrical member having axially front and rear ends, a front housing 2 sealingly attached to and closing the front end of the cylinder block 1, and a rear housing 3 attached to the rear end of the cylinder block 1 via a valve plate 4 and closing the rear end of the cylinder block 1. The front housing 2, the cylinder block 1, and the rear housing 3 are axially combined together by a plurality of long screw bolts 21 (only one screw bolt is typically shown in FIG. 1).

The cylinder block 1 and the front housing 2 of the framework define a crank chamber 5 in which movable and slidable elements are incorporated. Namely, an axial drive shaft 6 rotatably held by the front housing 2 and the cylinder block 1 via anti-friction front and rear bearings **7*a* and 7*b* axially extends through the crank chamber 5. The front end of the axial drive shaft outwardly extends beyond the front bearing 7*a* so that an external drive force such as a drive force supplied by an automobile engine via a solenoid clutch and a transmission mechanism is applied to the drive shaft 6. The drive shaft 6 is sealed by a shaft seal 7*c* arranged adjacent to the front bearing 7*a***.

The cylinder block 1 is provided with a plurality of cylinder bores 8 formed therein and arranged so as to surround the axis of rotation of the drive shaft 6. The cylinder bores 8 of the cylinder block 1 receive single-headed pistons 9 reciprocating therein to compress a refrigerant in the gas phase.

In the crank chamber 5, a rotor 10 is mounted on the drive shaft 6 so as to be rotated together with the drive shaft 6, and is axially supported by a thrust bearing 11 seated on an inner wall of the front housing 2. A swash plate 12 is mounted around the drive shaft 6 at a position adjacent to the rear face of the rotor 10, and is operatively connected to the rotor 10 in a later-described manner. The swash plate 12 is rearwardly urged constantly by a spring 13 which is arranged between the rotor 10 and the swash plate 12.

The swash plate 12 is provided with flat sliding faces **12*a*, 12*a* formed on peripheral portions of the front and rear faces thereof so as to circumferentially extend, and cooperate with semispherical shoes 14, 14 having spherically convex faces slidably engaged in spherical recesses formed at an end of-each piston 9**.

The swash plate 12 is also provided with a pair of brackets **12*b*, 12*b* centrally formed on the front face thereof so as to extend towards the rotor 10. The brackets 12*b*, 12*b* is provided in such a manner that the top dead center "T" of the swash plate 12 urging respective pistons 9 to their top dead positions is circumferentially located between the two brackets 12*b*. The pair of brackets 12*b*, 12*b* respectively fixedly hold one end of a guide pin 12*c*, and the other end of respective guide pins 12*c* is provided with a ball element 12*d* engaged in later-described support arms 17 of the rotor 10. The pair of brackets 12*b*, the guide pins 12*c*, and the balls 12*d*** constitute a part of a hinge mechanism "K"

functioning as a rotation-to-reciprocation conversion unit arranged between the rotor 10 and the single headed pistons 9. The swash plate 12 is provided with a central through-bore 20 formed therein in which the drive shaft 6 extends, and accordingly, the swash plate 12 is permitted to change its angle of inclination with respect to a plane perpendicular to the axis of rotation of the drive shaft 6. The swash plate 12 is further provided with a weight 15 riveted to the front face thereof at a position functioning as the bottom dead center of the swash plate 12. The movement of the swash plate 12 for increasing its angle of inclination is limited when a frontmost end 12*e* of the swash plate 12 abuts against rearmost end 10*a* of the rotor 10, and that for reducing its angle of inclination is limited when a central recess in the rear face of the swash plate 12 abuts against a circlip 22 fixedly mounted on the drive shaft 6 at a predetermined position.

The rotor 10 is provided with a pair of support arms 17, 17 projecting rearwardly from a portion of the rear face thereof toward the balls 12*d* of the guide pins 12*c*. The respective support arms 17 are provided with a guide hole 17*a* to receive the ball 12*d* of the guide pin 12*c*. The guide hole 17*a* of each of the support arm 17 is bored toward the axis of rotation of the drive shaft 6, and is in parallel with a plane defined by the top dead center "T" of the swash plate 12 and the axis of rotation of the drive shaft 6. The guide holes 17*a* movably receiving therein the balls 12*d* of the guide pins 12*c*, respectively, have an axis directed so that the top dead center of the respective pistons 9 is constantly unchanged irrespective of a change in the angle of inclination of the swash plate 12.

The rear housing 3 is provided with a central suction chamber 30 formed therein, and a discharge chamber 31 formed so as to surround the suction chamber 30. The valve plate 4 is provided with a plurality of suction ports 32 and a plurality of discharge ports 33 which are arranged in registration with the cylinder bores 8 of the cylinder block 1. Thus, the compressing chambers in respective cylinder bores 8 defined between the head of the pistons 9 and the valve plate 4 can communicate with the suction chamber 30 via the respective suction ports 32 and with the discharge chamber 31 via the respective discharge ports 33. The suction and discharge ports 32 and 33 are closed by suction valves and discharge valves (not shown in FIG. 1) attached to the opposite faces of the valve plate 4.

A gas extraction passageway 35 having a choke portion therein is arranged so as to extend through, for example, the cylinder block 1 so as to provide a fluid communication between a suction region including the suction chamber 30 and the crank chamber 5.

In accordance with the present invention, there is provided a pulsation suppressing chamber 90 in the framework to suppress pulsations in the discharge pressure of the compressed refrigerant gas during the operation of the compressor. More specifically, the pulsation suppressing chamber 90 is formed in a bulged portion 1*a* of the cylinder block 1 and in a corresponding portion 2*a* of the front housing 2, so as to have an appreciable volume thereof sufficient for weakening the pressure pulsation of the gas therein. The pulsation suppressing chamber 90 fluidly communicates with the discharge chamber 31 through a communication passageway 91 running through the cylinder block 1. The pulsation suppressing chamber 90 also communicates with an external refrigerating system through a delivery port 92 formed in a portion of the bulged portion 1*a* of the cylinder block 1 to receive a hose joint (not shown). The delivery port 92 is arranged to be in a substantially radial direction with respect to the axis of rotation of the drive shaft 6. The bulged portion 1*a* of the cylinder block 1 is also provided with a bore-like valve receiving chamber 93 surrounded by a cylindrical wall portion 94 and extending perpendicularly to the axis of the framework of the compressor, i.e., the axis of rotation of the drive shaft 6. The valve receiving chamber 93 receives therein a capacity control valve 50. The pulsation suppressing chamber 90 communicates with the crank chamber 5 via a gas supply passageway 95 which extends through a portion of the valve receiving chamber 93 an innermost end of which is exposed to an oil receiving reservoir 96 (FIG. 2) in the shape of a recess formed in the pulsation suppressing chamber 90. A passageway 97 is provided so as to extend through the cylinder block 1 and the rear housing 3 to thereby permit the valve receiving chamber 93 to communicate with a suction gas inlet port 34 formed in the rear housing 3. The passageway 97 introduces a pressure of the suction refrigerant gas into the capacity control valve 50 when the suction refrigerant gas is sucked from the external refrigerating system into the suction chamber 30 via the suction gas inlet port 34. Namely, the passageway 97 is fluidly connected to one of a plurality of pressure sensing ports provided for the capacity control valve 50 to which the above-mentioned gas supply passageway 95 is also fluidly connected via another pressure sensing port.

Figure 3:
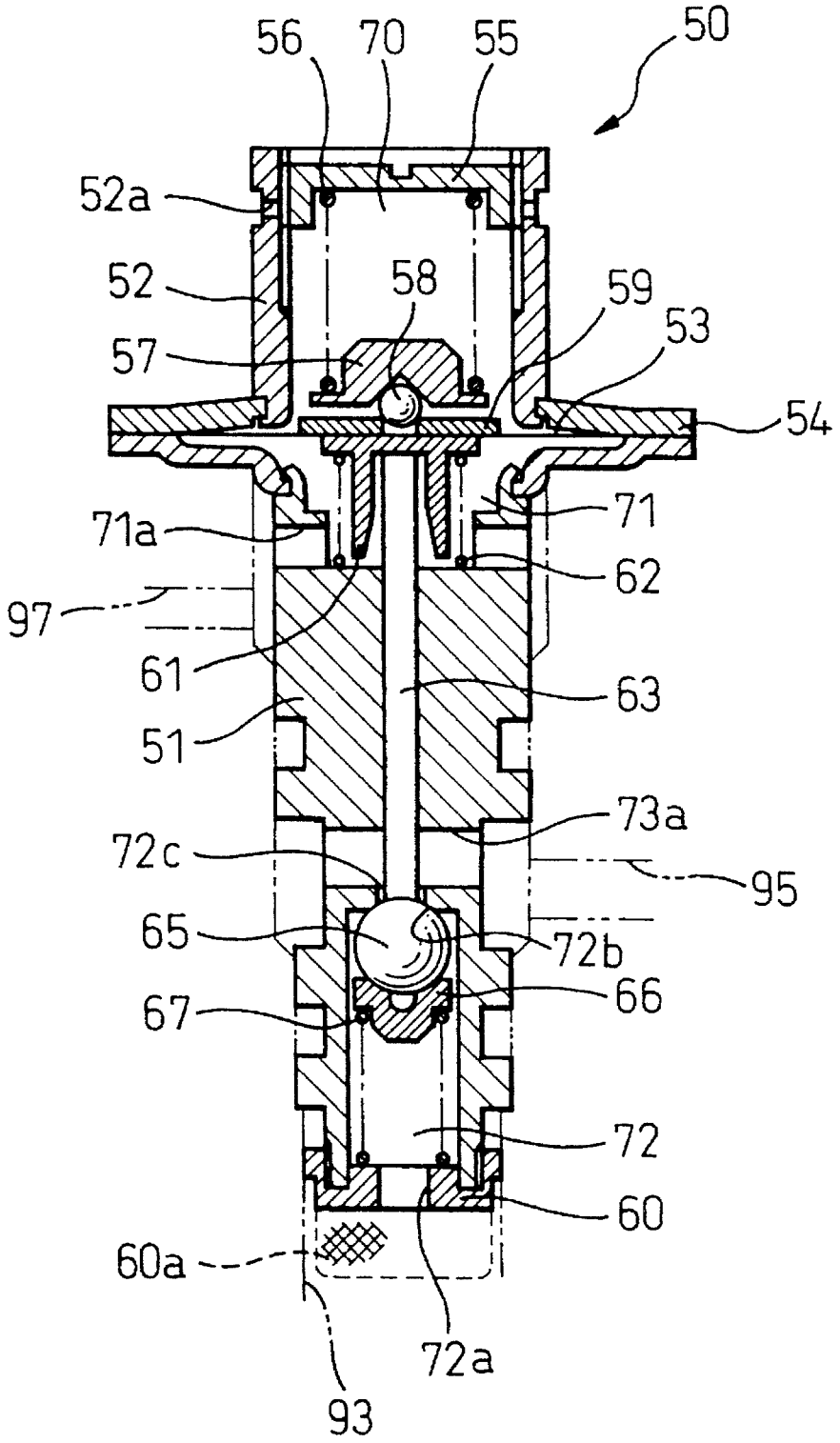
FIG. 3 is a cross-sectional view of a capacity control valve suitable for being accommodated in the compressor of FIG. 1.

As best shown in FIG. 3, the capacity control valve 50 is provided with a valve body 51, a cylinder 52, and a pressure sensing diaphragm 53 arranged between the valve body 51 and the cylinder 52 and fixed by holder members 54. The cylinder 52 has an open end which is closed by a lid 55 having a male threaded portion threadedly engaged in a female threaded portion of the cylinder 52. The cylinder 52, the lid 55, the diaphragm 53 and one of the holder members 54 define an atmospheric chamber 70 therein. The cylinder 52 is provided with an air hole 52*a* which communicates with the atmospheric chamber 70 via a backlash formed between the female threaded portion of the cylinder 52 and the male threaded portion of the lid 55. Thus, the interior of the atmospheric chamber 70 is constantly maintained at the atmospheric pressure level. A metallic retainer 57 is positioned in the atmospheric chamber 70, and a spring 56 is arranged between the lid 55 and the metallic retainer 57 so as to exhibit a given spring force to be applied to the metallic retainer 57 which is in indirect contact with the diaphragm 53 via a ball 58 and a ring-like retainer plate 59.

The valve body 51 is provided with a suction pressure chamber 71 defined between the diaphragm 53 and the other of the holder members 54 (the lower holder member 54 in FIG. 3), and the suction pressure chamber 71 communicates with the above-mentioned suction pressure detecting passageway 97 via a port 71*a*. Thus, a pressure corresponding to the suction pressure of the refrigerant gas prevails in the suction pressure chamber 71 which receives a cup-like holder 61 arranged to be in contact with the diaphragm 53. A spring 62 is arranged between the cup-like holder 61 and the bottom of the suction pressure chamber 71 so as to apply a predetermined spring force to the cup-like holder 61. A rod 63 is fixedly connected to the cup-like holder 61 at an end thereof, and is arranged so as to axially slide in the valve body 51. The other end of the rod 63 is provided with a ball valve 65 fixed thereto.

The valve body 51 is further provided with a discharge pressure chamber 72 arranged at a position axially opposing to the above-mentioned suction pressure chamber 71 and formed as a cylindrical chamber bored in a lower portion of the valve body 51. The lower portion of the valve body 51 is provided with a valve seat 72*b* located at an inner end of the discharge pressure chamber 72, an outer end of which is formed as an open end closed by a cap 60 threadedly engaged with a male threaded end of the lower portion of the valve body 51. The valve seat 72*b* is provided so that the ball valve 65 is permitted to seat therein to thereby close a central valve port 72*c* surrounded by the valve seat 72*b*, and to be moved away therefrom to thereby open the central valve port 72*c*.

The above-mentioned cap 60 is provided with a central open port 72*a* bored therein and fluidly connected to the afore-mentioned pulsation suppressing chamber 90 via the valve receiving chamber 93. Thus, the refrigerant gas at a discharge pressure is introduced into the discharge pressure chamber 72 via the central open port 72*a*. Namely, the discharge pressure constantly prevails in the chamber 72. A metallic holder 66 is arranged in the discharge pressure chamber 72 at a position where the holder 66 is in contact with the ball valve 65, and a spring 67 is arranged between an inner end of the cap 60 and the metallic holder 66 so as to apply a predetermined spring force to the ball valve 65 via the metallic holder 66. The end cap 60 is covered by a filtering member or meshed member 60*a*.

The valve body 51 is also provided with a lateral port 73*a* formed at an axially central portion thereof so as to communicate with the above-mentioned gas supply passageway 95. The lateral port 73*a* can communicate with the discharge pressure chamber 72 via the central valve port 72*c*.

The single headed piston type variable capacity refrigerant compressor provided with the above-mention ed construction and arrangement is filled with a refrigerant so that an internal pressure of the compressor is higher than a determined suction pressure when the compressor is stopped then, a combined force of the pressure prevailing in the suction pressure chamber 71 of the capacity control valve 50 and the force exhibited by the spring 62 is larger than a combined force of the atmospheric pressure prevailing in the atmospheric pressure chamber 70 of the control valve 50 and the force exhibited by the spring 56. Therefore, a differential force acts on the diaphragm 53 and urges the ball valve 65 connected to the rod 63 to move toward its closing position where the ball valve 65 seats on the valve seat 72*b* to thereby close the valve port 72*c*. Accordingly, the fluid communication between the pulsation suppressing chamber 90 via the gas supply passageway 95 is interrupted by the ball valve 65 at the valve port 72*c* during the stopping of the compressor.

When the compressor incorporated into a refrigerating system of an automobile is operated by the supply of an external drive force transmitted from an automobile engine to the drive shaft 6 via the solenoid clutch (not shown), the rotation of the drive shaft 6 is converted by the hinge mechanism K into a nutating motion of the swash plate 12 causing the reciprocation of the respective single headed pistons 9 in the cylinder bores 8. Thus, the compression of the refrigerant gas is carried out by the pistons 9.

At the initial stage of the operation of the compressor, temperature in an automobile cabin is rather high and the suction pressure of the refrigerant gas is also high. Therefore, the capacity control valve 50 maintains the interruption of the fluid communication between the crank chamber 5 and the pulsation suppressing chamber 90 via the gas supply passageway 95.

At this stage, a part of the refrigerant gas at a high pressure leaks from the cylinder bores 8 into the crank chamber 5 and is returned to the suction chamber 30 via the gas extraction passageway 35. Thus, a differential of the pressure prevailing in the crank chamber 5 and the suction pressure of the refrigerant gas sucked into the compressor is maintained at a small level compared with a predetermined pressure level. Accordingly, the single headed pistons 9 reciprocate in the respective cylinder bores 8 at their maximum stroke. Namely, a full capacity operation of the compressor is carried out. The refrigerant gas sucked from the suction chamber 30 into the respective cylinder bores 8 and subsequently compressed therein is discharged from the cylinder bores 8 into the discharge chamber 31, and then flows toward the pulsation suppressing chamber 90 via the passageway 91 (FIG. 1). Thus, the pulsation suppressing chamber 90 having an appreciable volume thereof functions to suppress pulsation in the discharge pressure of the compressed refrigerant gas while muffling noise generated by the pulsation of the compressed refrigerant gas. The pulsation-suppressed and noise-attenuated refrigerant is sent from the pulsation suppressing chamber 90 into the refrigerating system via the flange port 92.

The full capacity operation of the compressor contributes to reduction in the temperature within the automobile cabin, and accordingly, the suction pressure of the refrigerant gas is reduced to a pressure level lower than the predetermined pressure level. This reduction in the suction pressure of the refrigerant will reduce a pressure prevailing in the suction pressure chamber 71 of the capacity control valve 50 via the passageway 97 and the port 71*a* (FIG. 3). Therefore, the combination of the suction pressure and the spring force of the spring 62 becomes smaller than the combination of the atmospheric pressure in the atmospheric pressure chamber 70 and the spring force of the spring 56. Accordingly, the diaphragm 53 of the capacity control valve 50 is moved together With the rod 63 and the ball valve 65, to thereby open the valve port 72*c* between the discharge pressure chamber 72 and the gas supply passageway 95. Thus, the refrigerant gas at a high pressure is introduced from the pulsation suppressing chamber 90 into the crank chamber 5 via the gas supply passageway 95, the valve receiving chamber 93, the port 72*a*, the discharge pressure chamber 72, and the port 73*a*. Thus, the pressure prevailing in the crank chamber 5 is increased. When the pressure in the crank chamber 5 is increased while increasing a pressure differential between the pressure in the crank chamber 5 and the suction pressure of the refrigerant gas, the angle of inclination of the swash plate 12 is reduced. As a result, the stroke of the reciprocation of the respective single headed pistons 9 is reduced. Therefore, the operation of the compressor is changed from its large capacity operation to a small capacity operation. Thus, the delivery amount of the compressed refrigerant gas from the compressor toward the refrigerating system is reduced. Thereafter, the operation of the compressor is controlled by the capacity control valve 50 accommodated in the framework of the compressor in response to a change in the thermal load applied to the compressor.

In accordance with the present invention, the single headed piston type variable capacity refrigerant compressor is provided with the pulsation suppressing chamber (a muffling chamber) 90 and the capacity control valve 50 in the framework of the compressor, particularly, in the cylinder block 1 and the front housing 2. Accordingly, the construction of the rear housing 3 of the compressor can be simplified, and the entire axial length of the compressor is reduced in addition to suppression in the discharge pressure of the refrigerant gas. Further, since the pulsation suppressing chamber 90 is arranged so as to extend through both the cylinder block and the front housing, the pulsation suppressing chamber 90 can have an appreciably large effective volume, the muffling of noise generated by the pulsation of the compressed refrigerant gas can be effectively attenuated.

Further, as best shown in FIG. 2, the recessed oil reservoir 96 is arranged in the pulsation suppressing chamber 90, and the end of the valve receiving chamber 93 cooperating with the gas supply passageway 95 to supply the crank chamber 5 with the compressed refrigerant gas the discharge pressure pulsation of which is suppressed is exposed to the oil reservoir 96. The lubricating oil separated from the refrigerant gas and stored in the oil reservoir 96 is successfully supplied to the movable and sliding elements in the crank chamber 5 by the utilization of the controlling operation of the capacity control valve 5. Therefore, even when the compressor is operated at a small capacity condition where the amount of circulation of the refrigerant through the refrigerating system and the compressor is small, the movable and sliding elements in the crank chamber 5 are appropriately lubricated by the lubricating oil.

From the foregoing, it will be understood that according to the present invention, a variable capacity refrigerant compressor, particularly, a single headed piston type variable capacity compressor suitable for being incorporated into an automobile refrigerating system can exhibit an effective muffling function and can be reduced in size and length to thereby permit the compressor to be easily mounted in a narrow engine compartment of the automobile. Further, cumbersome arrangement of pipes and hoses between the compressor and the refrigerating system can be simplified.

It should be understood that many modifications and variations will occur to persons skilled in the art without departing from the spirit and scope of the invention as claimed in the accompanying claims.

We claim:

1. A variable capacity refrigerant compressor comprising:

a framework means including an axial cylinder block having axially front and rear ends and a plurality of cylinder bores formed therein, a front housing arranged so as to close the front end of said cylinder block, and define a crank chamber therein, and a rear housing arranged so as to close the rear end of said cylinder block and define at least one discharge chamber therein, said framework means having a suction pressure region therein for receiving a refrigerant before compression;

a plurality of reciprocating pistons received in the plurality of cylinder bores of said cylinder block to compress a refrigerant;

a drive shaft rotatably held by said cylinder block and said front housing of said framework means, and arranged so as to receive an externally supplied drive force;

a swash plate element mounted so as to be rotated together with said drive shaft to thereby reciprocate the plurality of pistons, and capable of changing its angle of inclination with respect to a plane perpendicular to the axis of rotation of said drive shaft;

a gas extraction passageway means for providing a constant fluid communication between said crank chamber and said suction pressure region of said framework means;

means for defining a pulsation suppressing chamber in said framework in such a manner that said pulsation suppressing chamber fluidly communicates with said discharge chamber of said rear housing and with an external refrigerating system;

means for defining a gas supply passageway interconnecting between said pulsation suppressing chamber and said crank chamber; and, a capacity control valve means accommodated in said pulsation suppressing chamber so as to regulate an amount of flow of a gas flowing through said gas supply passageway, in response to a change in a suction pressure of the refrigerant, to thereby constantly control-a pressure prevailing in said crank chamber.

2. A variable capacity refrigerant compressor according to claim 1, wherein said pulsation suppressing chamber is provided with a recessed oil chamber formed therein to receive a lubricating oil, and said gas supply passageway means has an open end exposed to said recessed oil chamber to thereby permit the lubricating oil to be supplied to said crank chamber via said gas supply passageway.

3. A variable capacity refrigerant compressor according to claim 1, wherein said capacity control valve means comprises:

a ball valve member for opening and closing a valve port arranged in a part of said gas supply passageway means; and a ball valve moving means for moving said ball valve element between a position closing said valve port and another position opening said valve port, in response to a change in a suction pressure of the refrigerant gas sucked into said suction pressure region of said framework means.

4. A variable capacity refrigerant compressor according to claim 3, wherein said ball valve moving means comprises a diaphragm element moving with said change in the suction pressure of the refrigerant.

5. A variable capacity refrigerant compressor according to claim 1, wherein said pulsation suppressing chamber is formed so as to internally extend through both said cylinder block and said front housing of said framework means.

6. A variable capacity refrigerant compressor according to claim 5, wherein said means for defining said pulsation suppressing chamber comprises a bulged portion integrally formed in said cylinder block and said front housing, said bulged portion defining therein said pulsation suppressing chamber which extends substantially in parallel with an axis of rotation of said drive shaft and has an extensive volume effective for deadening pulsation in a discharge pressure of said refrigerant supplied from said discharge chamber of said rear housing.

7. A variable capacity refrigerant compressor according to claim 6, wherein said bulged portion of said framework means further defines a valve chamber for receiving said capacity control valve means, and a gas delivery port fluidly connected to the external refrigerating system.

* * * * *